US005159785A

United States Patent [19]

Lüber

[11] Patent Number: 5,159,785

[45] Date of Patent: Nov. 3, 1992

[54] GRINDING OR CUTTING-OFF DISK FOR AN AUTOMATIC GRINDING MACHINE FOR CLEANING CASTINGS

[76] Inventor: Werner Lüber, Bahnhofstr. 23/32, 9602 Bazenheid, Switzerland

[21] Appl. No.: 491,077

[22] Filed: Mar. 9, 1990

[30] Foreign Application Priority Data

Mar. 29, 1989 [CH] Switzerland ..... 01130/89

[51] Int. Cl.[5] ..... B24D 7/02

[52] U.S. Cl. ..... 51/206 R; 51/206 NF

[58] Field of Search ..... 51/206 R, 206 NF, 207, 51/209 R, 165.77, 165.91, 165.71, 165.75, 165.76

[56] References Cited

U.S. PATENT DOCUMENTS 2,256,120 9/1941 Lovenston ..... 51/165.75
3,147,574 9/1964 LaPointe et al. ..... 51/165.77
3,978,624 9/1976 Merkel et al. ..... 51/165
4,674,235 6/1987 Inoue ..... 51/206 R

FOREIGN PATENT DOCUMENTS 0293673 12/1988 European Pat. Off. ..... 51/165.71
2422940 12/1975 Fed. Rep. of Germany ... 51/165.77
0885192 12/1961 United Kingdom ..... 51/206 R
1456150 11/1976 United Kingdom ..... 51/165.76

*Primary Examiner*—Robert A. Rose
*Attorney, Agent, or Firm*—Spencer, Frank & Schneider

[57] ABSTRACT

The circular grinding disk consists of an abrasive body, which is mounted via a metal hub on an axle or shaft. The grinding disk forms an electrode which is capable of being connected to a high-tension generator, the counter-electrode thereof being a casting, between which, upon approach, an arc is ignited, which generates a control signal. For this purpose, the grinding disk is electrically-conductive over the entire extent thereof.

2 Claims, 1 Drawing Sheet

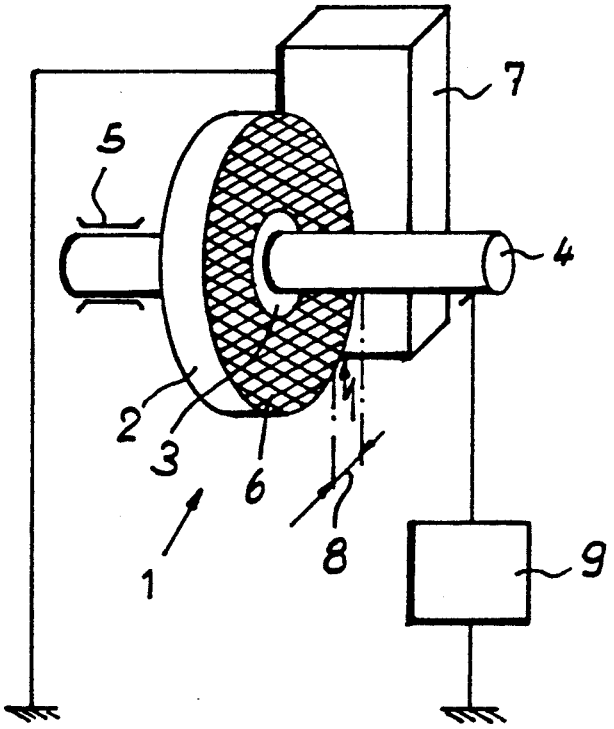
7
5
4
2
3
6
8
1
9

GRINDING OR CUTTING-OFF DISK FOR AN AUTOMATIC GRINDING MACHINE FOR CLEANING CASTINGS

BACKGROUND OF THE INVENTION

The present invention relates to a grinding or cutting-off disk for an automatic grinding machine for cleaning castings.

In a patent application filed simultaneously by the same applicant, a process for controlling an automatic grinding machine for cleaning castings is described, by which a grinding or cutting-off disk engages on a clamped casting and then at least the operating advance of the grinding or cutting-off disk is program controlled by means of control data dependent on the workpiece, wherein the distance of proximity between grinding or cutting-off disk and casting serves as measure of comparison for releasing an electric control signal for inducing the program control by a regulable high-tension potential being built up between the grinding or cutting-off disk and the casting; the height of the tension and the size of the air gap, forming a sparkover gap, between the grinding or cutting-off disk and the casting being a measure for the ignition tension, which brings about the electric control signal.

As a result of these steps, a control signal can be generated which is effective prior to a contact between grinding or cutting-off disk and casting, and thus introduce a precise program-controlled machining of the casting, independent and unaffected by vibrations. In this connection, it is, moreover, insignificant what material the workpiece consists of.

SUMMARY OF THE INVENTION

However, this process requires a special grinding or cutting-off disk, which is the object of the present invention and which distinguishes itself by an electrically-conductive construction over the entire extent thereof.

Such a grinding or cutting-off disk can thus, in addition to the processing functions thereof, form one of the two electrodes of a high-tension ignition gap, the other electrode being the cast workpiece to be processed; between said two electrodes, then, at enough high tension and sufficient proximity, an arc ignition takes place, which leads to the aforementioned control signal.

In this connection, the construction of the grinding or cutting-off disk can be advantageously such, that the abrasive or grinding body is coated or permeated by a mesh or web of copper or a copper foil, or electrically-conductive structures, such as graphite, are bound in the abrasive body.

The abrasive body can then be connected via the hub thereof to a pole of a high-tension generator.

BRIEF DESCRIPTION OF THE DRAWING

An exemplary embodiment of the subject of the invention will be more closely explained in the following by reference to the drawing, which shows in diagrammatic representation a grinding or cutting-off disk for an automatic grinding machine for cleaning castings.

DETAILED DESCRIPTION OF THE PREFERRED EMBODIMENTS

The grinding or cutting-off disk, represented here as a circular grinding disk 1, comprises in customary manner an abrasive body 2, which is mounted via a metal hub 3 on an axle or shaft 4, which is supported in a bearing 5.

In this connection, grinding disk 1 is to interact with the casting 7 in order to ignite an arc in the proximity gap 8 at a sufficient proximity of disk and casting, which generates the control signal.

For this, the grinding disk 1 forms an electrode, which is capable of being connected to a high tension generator 9, the casting 7 forming the counter-electrode thereof.

In order to be effective as an electrode, the grinding or cutting-off disk is electrically conductive over the entire construction thereof.

For this, electrically-conductive structures, such as graphite, may be bound in the abrasive body 2, or the abrasive body is, as is here represented, coated or permeated by a web or mesh, preferably made from copper, or by copper foil or the like.

The abrasive body 2 is thus via the hub 3 or the axle or shaft 4 thereof and via suitable sliding contacts or the like electrically connected to the high-tension generator 9.

Such a grinding or cutting-off disk according to the invention can for the rest be constructed in conventional manner.

While there are shown and described preferred embodiments of the invention, it is to be distinctly understood that the invention is not limited thereto but may be embodied and practised within the scope of the following claims.

What I claim is:

1. A grinding wheel for an automatic grinding machine for cleaning castings which castings are electrically connected to a first pole of a high-tension generator to form a first electrode when received by the grinding machine during operation thereof, said grinding wheel comprising:

a disc-shaped abrasive body having parallel sides and provided with electrically conductive structural means for forming a second electrode electrically connected with a second pole of the generator, said electrically conductive structural means extending across substantially the entire extent of at least one parallel side of said abrasive body; and an electrically conductive hub and a shaft, for rotatably supporting said abrasive body, said hub being disposed between said shaft and said abrasive body, said hub for electrically connecting said abrasive body with the second pole of the generator.

2. A grinding wheel as defined in claim 1, wherein said shaft is electrically conductive, said shaft being for electrical connection between said hub and the second pole of the generator, said shaft, said hub, and said abrasive body being thereby electrically connected with the second pole of the generator.

* * * * *